United States Patent [19]

Honda et al.

[11] Patent Number: 4,559,909

[45] Date of Patent: Dec. 24, 1985

[54] VALVE MECHANISM FOR AN INTERNAL COMBUSTION ENGINE

[75] Inventors: Shoich Honda; Osamu Muto; Masaru Shirakura, all of Tokyo, Japan

[73] Assignee: Honda Giken Kogyo Kabushiki Kaisha, Tokyo, Japan

[21] Appl. No.: 638,050

[22] Filed: Aug. 6, 1984

[30] Foreign Application Priority Data

Aug. 4, 1983 [JP] Japan ..... 58-142983

[51] Int. Cl.[4] ..... F01L 31/22

[52] U.S. Cl. ..... 123/90.28; 123/90.67; 123/188 SC

[58] Field of Search ..... 123/90.1, 90.12, 90.27, 123/90.28, 90.3, 90.65, 90.67, 90.66, 188 SA, 188 SB, 188 SC; 251/337; 267/168, 177

[56] References Cited

U.S. PATENT DOCUMENTS

| | | | |
|---|---|---|---|
| 1,520,575 | 12/1924 | Kandarian | 251/337 |
| 1,612,030 | 12/1926 | Lange | 251/337 |
| 3,557,762 | 1/1971 | Mitchell | 123/90.1 |

FOREIGN PATENT DOCUMENTS

| | | | |
|---|---|---|---|
| 2054350 | 10/1972 | Fed. Rep. of Germany | 123/188 SA |
| 2613484 | 10/1977 | Fed. Rep. of Germany | 251/337 |
| 862633 | 3/1941 | France | 123/302 |

*Primary Examiner*—Craig R. Feinberg
*Assistant Examiner*—David A. Okonsky
*Attorney, Agent, or Firm*—Lyon & Lyon

[57] ABSTRACT

A valve mechanism for a poppet valve of an internal combustion engine having a conventional cam and rocker arm control mechanism. Valve springs are positioned and compressed between the poppet valve and a valve spring retainer. The valve spring retainer moves relative to the engine head responsive to engine speed to further compress the valve springs with increased engine speed. A hydraulic controller operates through linkage employing a detent mechanism such that stepwise advancement of the valve spring retainer results to approximate an ideal engine speed versus valve spring force curve.

9 Claims, 5 Drawing Figures

VALVE MECHANISM FOR AN INTERNAL COMBUSTION ENGINE

BACKGROUND OF THE INVENTION

The field of the present invention is control mechanisms for poppet valves as may be employed in internal combustion engines.

Internal combustion engines have been developed for vehicles and other uses where the engine is expected to run at a wide range of engine speeds. Among other difficulties created by the demand for a wide range of operating speeds is the need for the valve actuating mechanisms to accommodate inertial forces varying with engine speed. Of particular difficulty are the valve closing springs. Spring forces remain constant regardless of the engine speed.

Because of the inability to vary the valve spring force with variations in the inertial load, design choices have been required which require compromise between high speed valve performance and more efficient, less expensive designs. If the valve control mechanism is designed for high speed performance, stronger and harder materials are needed to overcome the stronger valve spring. The increased forces and frictional forces of such a design require more power from the engine thereby reducing its efficiency. By designing the valve mechanism to operate efficiently at lower speeds, higher rpm's may damage the mechanism not designed for such operation and the valves may experience float or rebound. Hence, design compromises have been required to accommodate the foregoing problems without the ability to vary spring forces with engine speed.

SUMMARY OF THE INVENTION

The present invention is directed to valve control mechanisms capable of varying the valve spring forces with engine conditions. By doing so, less expensive materials may be employed, engine efficiency is increased and proper valve operation at high speeds is maintained.

To accomplish the foregoing, a valve spring retainer positioned at one end of a valve spring or set of springs may be arranged such that there are means for adjusting the position of the retainer with a variation in engine conditions. Such a device may be accomplished through the sensing of engine speed to control an actuator which in turn adjusts the retainer. With increasing engine speed, the retainer may be forced toward the other end of the valve spring abutting against the valve assembly to increase spring force. Thus, only at high engine speed is high valve force experienced with the attendant increases in friction, component load and power requirements.

Accordingly, it is an object of the present invention to provide improved valve control mechanisms having variable valve spring forces. Other and further objects and advantages will appear hereinafter.

DETAILED DESCRIPTION OF THE PREFERRED EMBODIMENT

Figure 1:
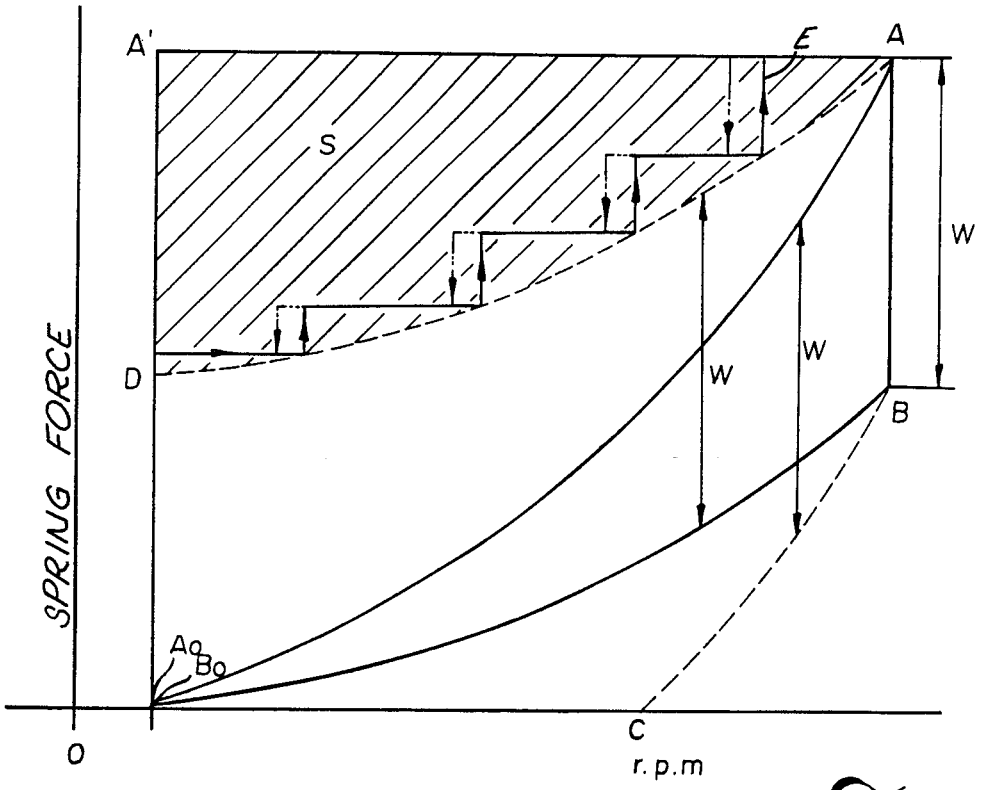
FIG. 1 is a graph illustrating a plurality of curves for engine speed versus valve spring force.

Turning in detail to the drawings, the graph of FIG. 1 illustrates engine speed versus spring force. As a basis for comparison, the line A'-A represents a spring force for a conventional valve mechanism wherein the spring force is shown not to vary with the speed of the engine. The line A'-A represents the spring force with the valve fully open and with the spring configured to provide the force required to properly actuate the valve at a maximum rpm as defined at the point A. Such a conventional spring would have a spring force in the closed position represented by the value B. The values A and B differ by an amount W due to the stroke length of the valve.

Also represented on the graph of FIG. 1 is the ideal inertial force curve at the valve open position represented by line $A_o$-A and at the valve closed position by line $B_o$-B. At the maximum rpm, the forces again vary by an amount W reflecting the valve stroke length.

In developing an actual valve spring force curve, the line $A_o$-A with the valve in the full open position would satisfy the requirements at that position. However, if such a curve is approximated, the force curve for the valve spring with the valve in the closed position would differ by the amount W and would therefore be represented by the curve C-B. Such a curve is unacceptable because the forces are shown to be less than the inertial forces represented by line $B_o$-B. The closed valve force curve for the valve spring must, therefore, at least meet the curve $B_o$-B.

With the foregoing criteria, an ideal open valve force curve for the valve spring is established along forced curve line D-A. Curve D-A is identical to the curve $B_o$-B but is displaced upwardly by an amount W so as to remain above, and meet at point A, the inertial force curve $A_o$-A for the valve in the open position. As will be seen from the mechanism of the preferred embodiment, this curve D-A is approximated by a step curve E. The points of the transition between succeeding steps is shown to vary depending on whether the engine is increasing or decreasing in speed. The employment of a stepped system avoids dynamic oscillation which might otherwise occur in a continuously varying mechanism. Additionally, the displacement of the curve depending on the condition of acceleration or deceleration avoids continuous oscillation of the mechanism when the engine may be running at a substantially constant speed at a transition point.

As can graphically be illustrated in FIG. 1, close adherence to the ideal curve D-A provides the required spring force at maximum rpm and yet saves the amount of force at lower speed conditions as represented by the shaded area S. In this way, reduced wear and power losses are achieved.

Figure 2:
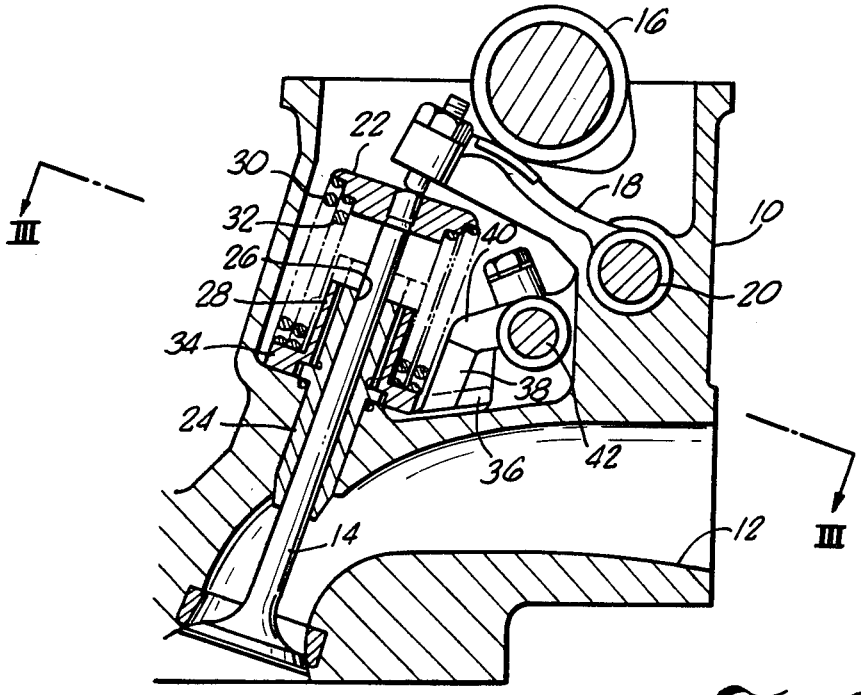
FIG. 2 is a cross-sectional view of a valve control mechanism in an engine head.

Looking specifically to the mechanism of the preferred embodiment, FIG. 2 illustrates an engine head 10 having an intake or exhaust passage 12. Positioned at the port of the passage 12 is a poppet valve 14. The poppet valve 14 is opened by a conventional valve control mechanism including a cam 16 rotatably mounted to the engine head 10 and driving a rocker arm 18. The rocker arm 18 is pivotally mounted to the engine head at pivot 20 and operates to open the poppet valve 14. A conventional spring retainer 22 is affixed to one end of the poppet valve 14 to move therewith.

A valve guide 24 is fixed within the engine head 10. The poppet valve 14 extends through this guide 24 to oscillate back and forth therein. The valve guide 24 includes an upwardly extending collar 26 about which is positioned a valve spring retainer 28. The valve spring retainer 28 cooperates with the retainer 22 to compress two valve springs 30 and 32 therebetween. Thus, the springs are effectively compressed between the poppet valve 14, through the retainer 22, which opens and closes as required and the valve spring retainer 28 which is positioned relative to the engine head 10 so as not to move with the poppet valve 14. A flange 34 on the valve spring retainer 28 provides a seat for the springs 30 and 32.

Means are provided in association with the valve spring retainer 28 for adjusting the position of the retainer relative to the engine head 10. This is accomplished axially along the poppet valve 14 to move the valve spring retainer 28 toward the retainer 22 as a means for compressing the valve springs 30 and 32. This adjustment may be responsive to the speed of the engine such that greater compression of the springs 30 and 32 is achieved at higher rpm's. In this way, the advantages graphically illustrated in FIG. 1 may be realized.

Figure 3:
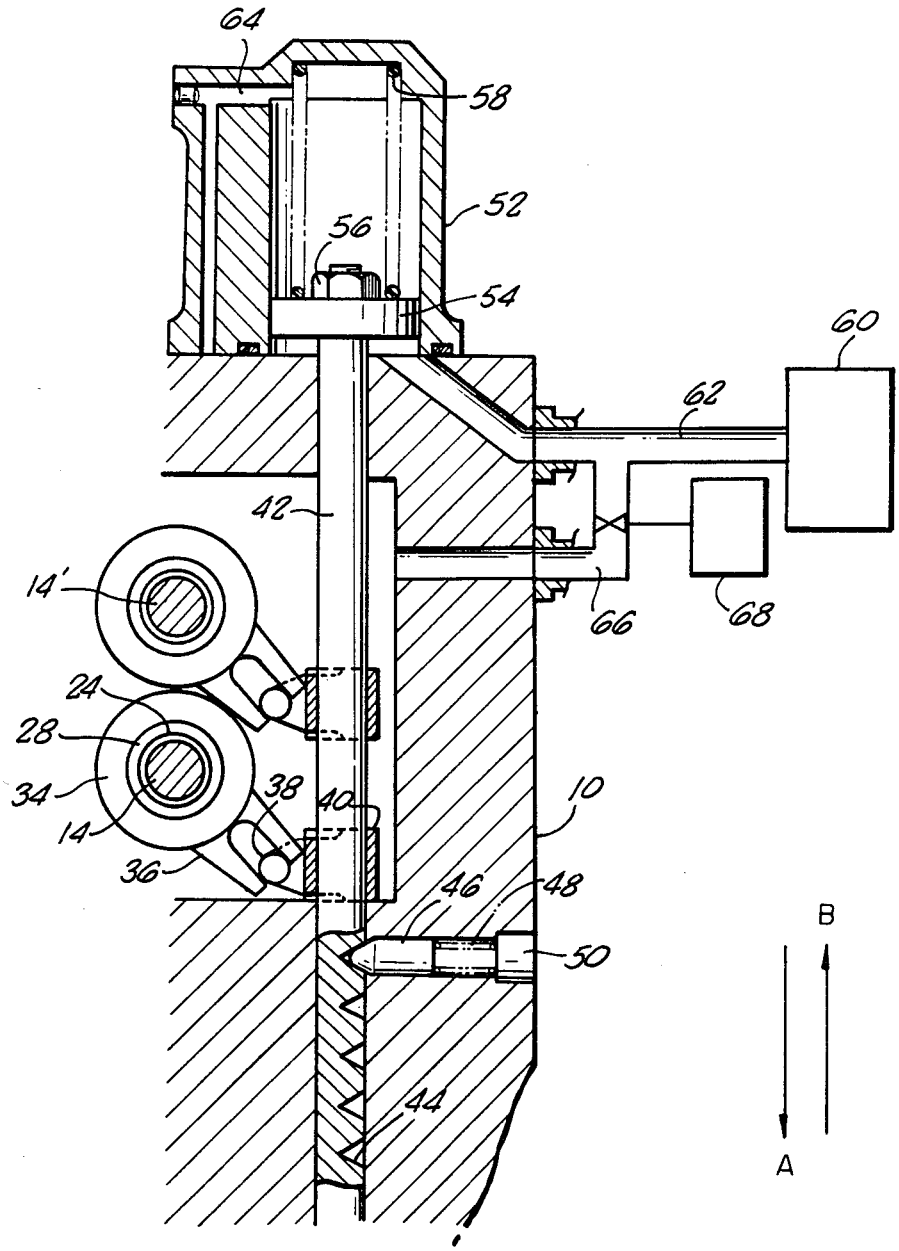
FIG. 3 is a cross-sectional view taken along line III—III of FIG. 2.

To accomplish the foregoing adjustment of the valve spring retainer 28, the retainer 28 is coupled with a position control mechanism responsive to engine speed. As illustrated in the preferred embodiment, the retainer 28 and the collar 26 of the valve guide 24 are associated such that rotation of the retainer 28 results in axial movement thereof relative to the valve guide 24. A fork 36 extends from the flange 34 of the retainer 28 to provide angular control over the valve spring retainer 28. This arrangement is best illustrated in FIG. 3 where two valves 14 and 14' are illustrated as incorporating identical mechanisms.

The position control mechanism includes linkage for cooperating with the fork 36. This mechanism includes pins 38 which are fixed by means of brackets 40 to a control rod 42. The control rod 42 is slidably arranged within the engine head 10 to rotate the valve spring retainers 28 which causes them to move axially as described above.

The linkage further includes a detent mechanism to provide step-wise advancement of the control rod 42 such that the stepped curve E is achieved. The detent mechanism includes stops 44 along the rod 42. A pin 46 is biased toward the rod 42 and stops 44 by means of a detent spring 48 positioned by a plug 50. The pin 46 is somewhat rounded and the entire configuration, including the precompression on the spring 48, is designed to require a preselected force such that the pin 46 acts as a member resiliently and selectively engaging the stops 44. When sufficient force builds up along the rod 42, the detent will allow the rod to move step-wise to the next stop 44.

Figure 4:
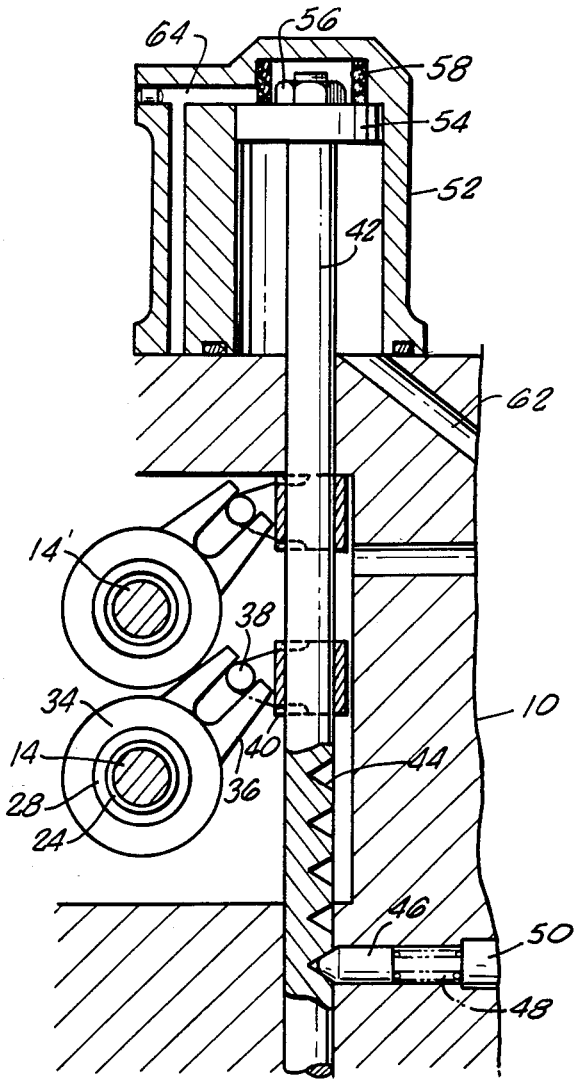
FIG. 4 is a cross-sectional view as in FIG. 3 with the control mechanism in an advanced position.
Figure 5:
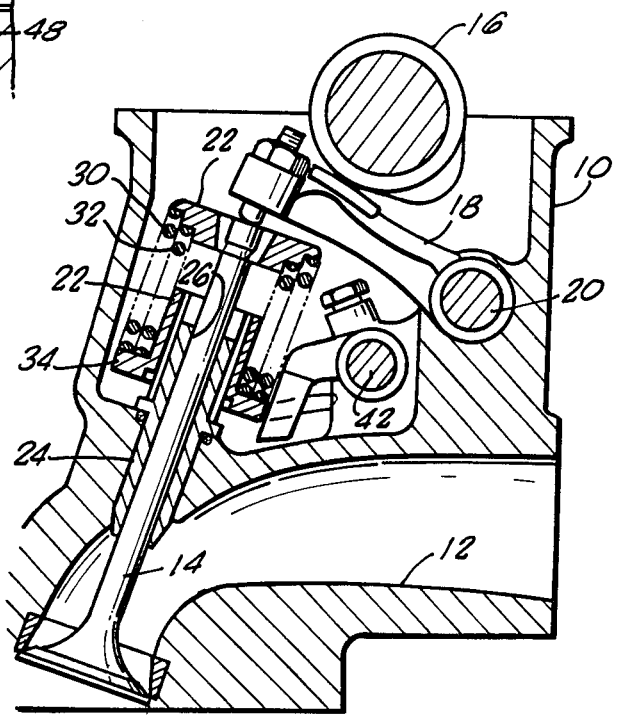
FIG. 5 is a cross-sectional elevation as in FIG. 2 with the control mechanism advanced as in FIG. 4.

The position control mechanism controls the linkage by means of a controller assembly. This assembly includes a hydraulic cylinder 52 including a piston 54 located therein. The piston 54 is fixed to one end of the linkage rod 42 by means of a bolt 56. A bias spring 58 forces the rod 42 to one end of the cylinder 52 which, in this embodiment represents the low speed position of the system. The spring 58 has sufficient force under compression to overcome the detent in cooperation with the restoring force of the springs 30 and 32. The piston 54 is illustrated in the slow speed configuration in FIG. 3 wherein the linkage rod 42 has moved in the direction of arrow A. FIG. 4 illustrates the same embodiment with the rod 42 having moved in the direction of arrow B to the maximum high speed position. The high speed position is also illustrated in FIG. 5.

To control the piston 54 within the hydraulic cylinder 52, a source of hydraulic pressure 60 is schematically illustrated. The source of such pressure may conveniently be an oil pump associated with the engine. A direct passage 62 extends to the hydraulic cylinder 52 on one side of the piston 54. Relief is provided to the other side of the piston 54 through a relief passage 64. To control the pressure from the pressure source to the hydraulic cylinder, a control passage 66 extends from the main passage 62. A control valve mechanism 68 operates to selectively open and close the passage 66 in order to regulate pressure within the hydraulic cylinder 62. This relief valve arrangement is conventionally controlled by a speed sensor which conveniently measures engine speed. As engine speed increases, the relief valve 68 is closed to increase the pressure to the hydraulic cylinder 52, moving the piston 54 upwardly such that the link 42 moves step-wise to rotate the valve spring retainers 28. As engine speed is reduced, the process is reversed.

Variations on the foregoing preferred embodiment are naturally possible. A pneumatic cylinder or an electromagnetic solenoid may be employed in place of the hydraulic cylinder illustrated. The number of valve springs may also be varied and the number of stops in the detent mechanism may be varied to best accommodate requirements. Other cam and rocker arm mechanisms as known in the art may be employed. The number of cylinders and the valves associated therewith which employ the teachings of the present invention may be chosen according to engine requirements.

Thus, a device is disclosed for varying valve spring forces responsive to engine speeds. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A valve mechanism for an engine, comprising a poppet valve;

a valve spring retainer adjustably positioned on the engine at said poppet valve;

a valve spring effectively compressed between said poppet valve and said valve spring retainer; and means for adjusting the position of said valve spring retainer responsive to preselected engine conditions, said adjusting means including a stepping mechanism providing step-wise adjustment of said second valve spring retainer.

2. The valve mechanism of claim 1 further comprising a valve guide through which said poppet valve extends, said valve guide including a collar extending from the engine, said valve spring retainer being positioned on said collar.

3. The valve mechanism of claim 1 wherein said means for adjusting the position of said retainer is responsive to engine speed.

4. The valve mechanism of claim 3 wherein said means positions said retainer progressively toward said first end of said spring responsive to increasing engine speed.

5. A valve mechanism for an engine, comprising a poppet valve;

a valve spring retainer adjustably positioned on the engine at said poppet valve;

a valve spring effectively compressed between said poppet valve and said valve spring retainer; and a position control mechanism including a controller and linkage between said controller and said valve spring retainer, said position control mechanism being constructed and arranged to adjust the position of said valve spring retainer responsive to increasing engine speed, said linkage including a stepping mechanism providing stepwise adjustment of said second valve spring retainer.

6. The valve mechanism of claim 5 wherein said controller includes a piston and hydraulic cylinder, a source of hydraulic pressure to said hydraulic cylinder, and a control valve controlling pressure to said hydraulic cylinder from said source of pressure responsive to engine speed.

7. A valve mechanism for an engine, comprising a poppet valve;

a valve spring retainer adjustably positioned on the engine at said poppet valve;

a valve spring effectively compressed between said poppet valve and said valve spring retainer; and a position control mechanism including a hydraulic cylinder having a piston therein and a resilient member biasing said piston toward a first end of said cylinder, a source of hydraulic pressure extending to said hydraulic cylinder to oppose said resilient member, a control valve controlling pressure to said hydraulic cylinder from said source of hydraulic pressure and linkage extending from said piston to said valve spring retainer constructed and arranged to adjust the position of said retainer responsive to movement of said piston against said resilient member and a detent mechanism on the engine including a plurality of stops on said linkage to provide step-wise advancement of said valve spring retainer.

8. The valve mechanism of claim 7 wherein said control valve is constructed and arranged to increase pressure to said hydraulic cylinder with increasing engine speed.

9. A valve mechanism for an engine, comprising a poppet valve;

a valve spring retainer adjustably positioned on the engine at said poppet valve;

a valve spring effectively compressed between said poppet valve and said valve spring retainer; and a position control mechanism including a controller and linkage between said controller and said valve spring retainer, said position control mechanism being constructed and arranged to adjust the position of said valve spring retainer reponsive to increasing engine speed, said linkage including a plurality of stops and a member resiliently and selectively engaging said stops, one of said member and said stops being fixed relative to the engine.

* * * * *